United States Patent [19]

Stauble

[11] 4,074,635

[45] Feb. 21, 1978

[54] PLASTIC SHELF UNIT

[75] Inventor: Alfred G. Stauble, Hollis, N.H.

[73] Assignee: Belleview, Inc., Hollis, N.H.

[21] Appl. No.: 781,685

[22] Filed: Mar. 28, 1977

[51] Int. Cl.[2] ..... A47B 17/00

[52] U.S. Cl. ..... 108/27; 108/152; 211/90; 211/135; 211/153

[58] Field of Search ..... 108/27, 152; 211/88, 211/90, 135, 153, 188

[56] References Cited

U.S. PATENT DOCUMENTS

| | | | |
|---|---|---|---|
| 1,270,718 | 6/1918 | Ford | 211/135 X |
| 3,100,582 | 8/1963 | Lockwood | 211/188 X |
| 3,669,035 | 6/1972 | Grossman | 108/152 |
| 3,919,950 | 11/1975 | Frazelle et al. | 108/152 X |

*Primary Examiner*—James C. Mitchell

[57] ABSTRACT

An integrally molded, one-piece, plastic shelf unit which can be mounted directly on a surface either singly, or adjacent similar units, without the need for separate mounting structures such as brackets, and which is nestable for convenient shipment and storage is disclosed. It has a flat horizontal support wall, an integral front wall which extends downwardly from the front edge of the support wall, integral sidewalls which extend downwardly from the side edges of the support wall, and an integral external mounting flange wall which extends outwardly from the rear edges of the support wall and the sidewalls to provide an unobstructed rear opening in which a similar unit may be nested.

5 Claims, 13 Drawing Figures

FIG 12
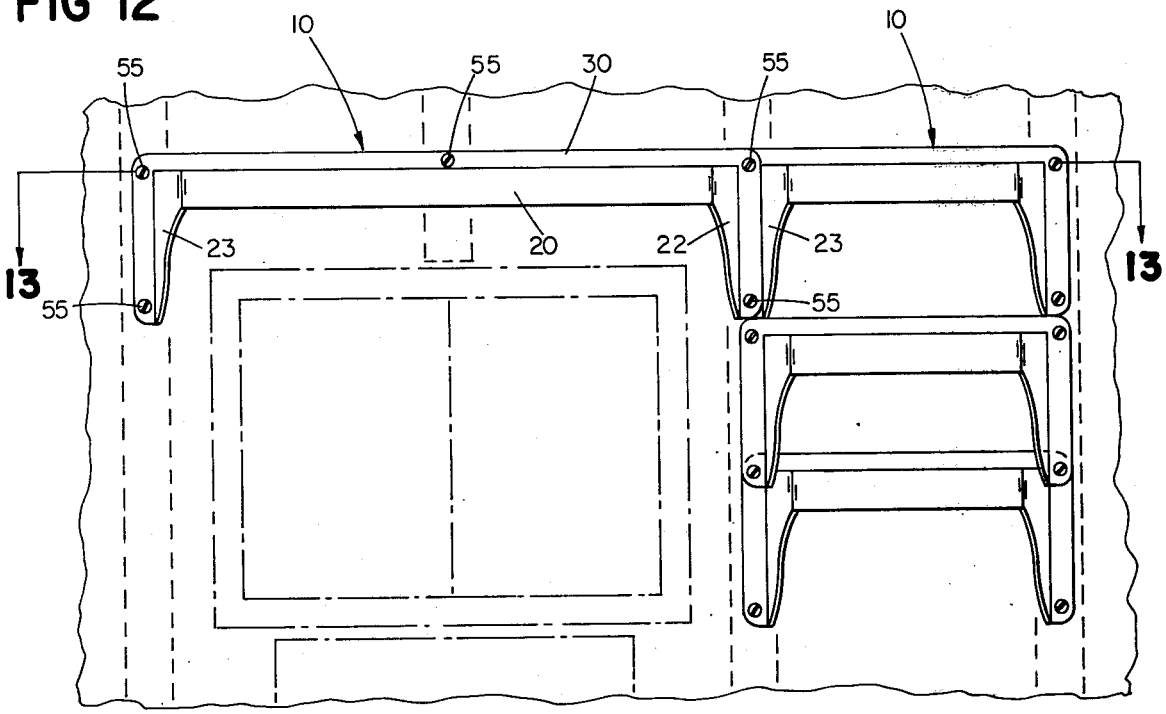
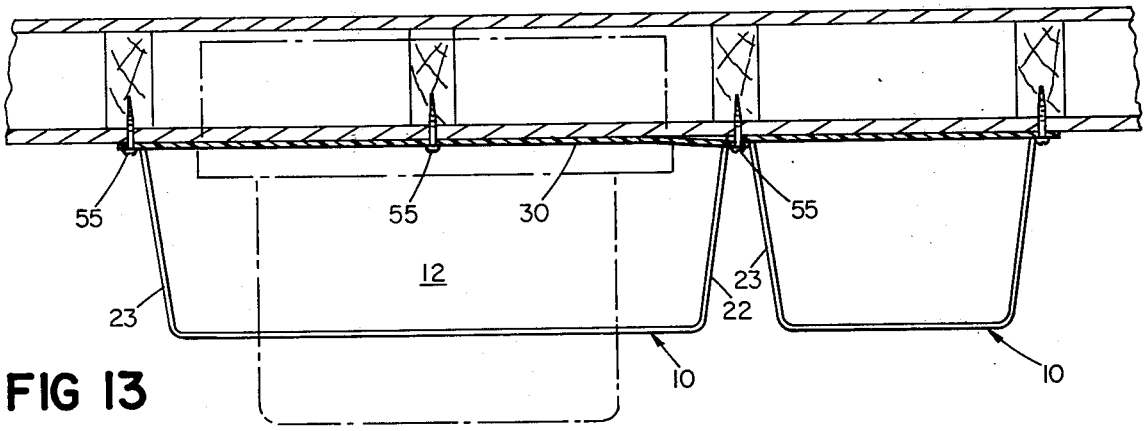
FIG 13

PLASTIC SHELF UNIT

BACKGROUND OF THE INVENTION

This invention relates to shelf structures, and, more particularly, to integrally molded, one-piece, plastic shelf units which are nestable for convenient storage and shipment.

Various types of plastic shelves are known in the art, being disclosed, for example, in U.S. Pat. Nos. 3,669,035 and 3,919,950. However, the shelves of such patents are deficient both from the standpoint of appearance and convenience in shipping and storage. From the standpoint of appearance, such shelves usually require complex and unsightly mounting structures. They are also difficult to ship and store in quantity because each shelf unit, together with its mounting structures, usually consists of a number of separate components which occupy a large volume of space.

SUMMARY OF THE INVENTION

Accordingly, it is a major object of the present invention to provide a one-piece shelf unit which can be conveniently stored or shipped by nesting with a number of similar units.

It is another object of the invention to provide such a shelf unit which can be mounted singly or adjacent similar units without the need for separate mounting brackets.

It is still another object of the invention to provide such a shelf unit which is simple, sturdy and inexpensive, and which can be injection molded in one piece.

In order to accomplish these objects, the invention provides a plastic shelf unit having a flat horizontal support wall with a rear edge longer than its front edge. The distance between the side edges of the support wall increases rearwardly, preferably symmetrically. An integral front wall extends downwardly from the front edge of, and integral sidewalls extend downwardly from the side edges of, the support wall. There is an integral external mounting flange wall which extends outwardly from the rear edges of the support wall and the sidewalls, providing an unobstructed rear opening which is greater in horizontal dimension than the front wall.

The support wall preferably has a rim extending upwardly from its front and side edges which together with the flange wall provides a depressed support wall for the retention of liquid. Preferably, the side edges of the support wall are symmetrical, and the support wall is trapezoidal in plan. The sidewalls preferably have front edges contiguous with and of the same length as the side edges of the front wall and rear edges which are of greater length than the front edges. Preferably, the external mounting wall is planar, extending upwardly from the rear edge of the support wall and outwardly from the rear edges of the sidewalls.

For the purpose of fully explaining the above and still further features of the invention, reference is now made to the following description of a preferred embodiment thereof, together with the accompanying drawings, wherein:

BRIEF DESCRIPTION OF THE DRAWINGS

FIG. 12 is a side elevation showing shelf units of the invention mounted about a cabinet shown in phantom; and FIG. 13 is a section, taken on line 13–13 of FIG. 12, showing in detail shelf units of the invention mounted in side-by-side horizontal alignment.

DETAILED DESCRIPTION

Figure 1:
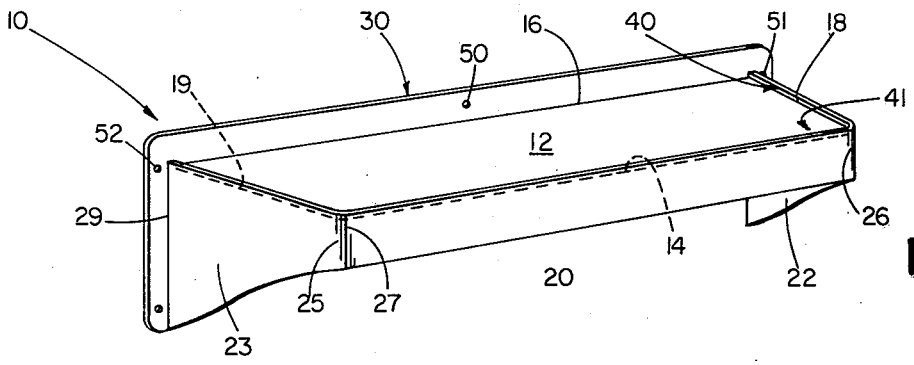
FIG. 1 is a perspective view of the shelf unit of the invention.

Referring to the drawings, in FIG. 1 is shown the novel shelf unit of the invention, generally designated 10.

Figure 2:
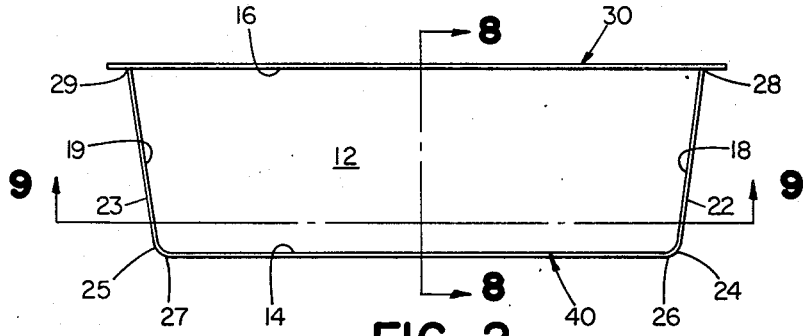
FIG. 2 is a plan view thereof.
Figure 3:
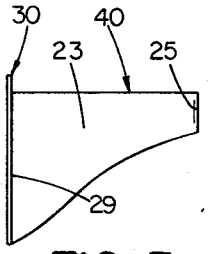
FIGS. 3, 4, 5 and 6 are left side, front, right side and rear elevations thereof.

As best shown in FIG. 2, flat horizontal support wall 12 has a front edge 14, a rear edge 16 which is longer than front edge 14, and side edges 18 and 19 which extend between front edge 14 and rear edge 16. The distance between the side edges 18 and 19 increases symmetrically rearwardly.

Figure 4:
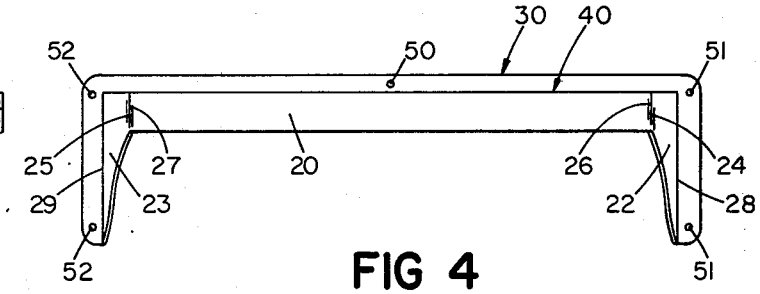
Figure 5:
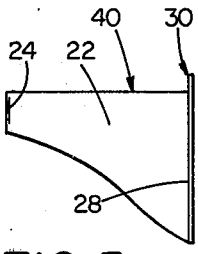

Integral front wall 20 extends vertically downwardly from front edge 14 of support wall 12 as shown in FIG. 4.

Integral sidewalls 22 and 23 extend vertically downwardly from side edges 18 and 19 of support wall 12, and have front edges 24 and 25 contiguous with and of the same vertical length as side edges 26 and 27 of front wall 20, as best shown in FIGS. 1 and 4.

Figure 6:
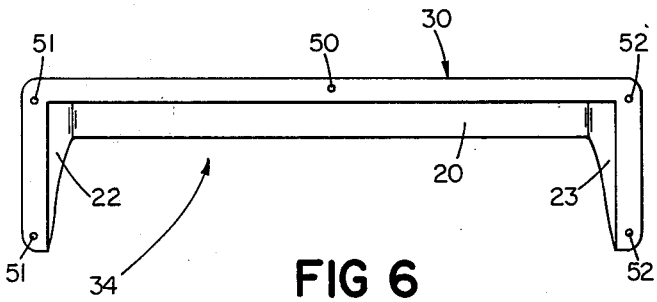
Figure 8:
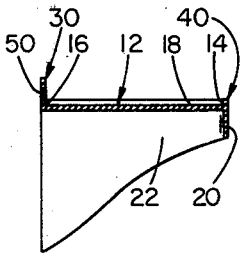
FIG. 8 is a side sectional view, taken along line 8–8 of FIG. 2.
Figure 7:
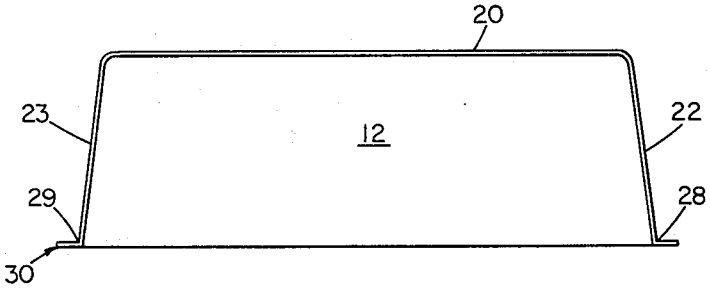
FIG. 7 is a bottom view thereof.
Figure 9:
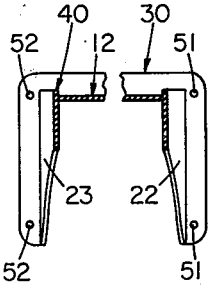
FIG. 9 is a side sectional view, partly broken away, taken along line 9–9 of FIG. 2.
Figure 10:
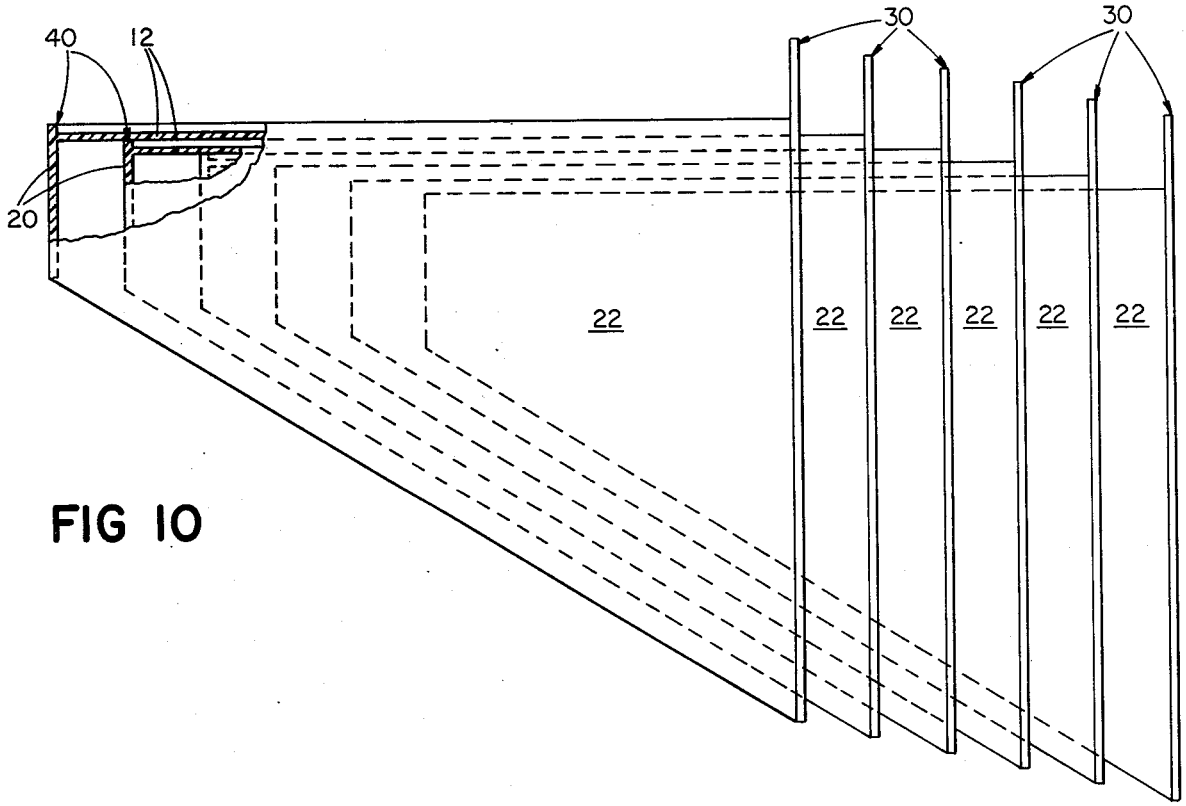
FIG. 10 is a side elevation, partly broken away, of shelf units of the invention nested for storage or shipment.
Figure 11:
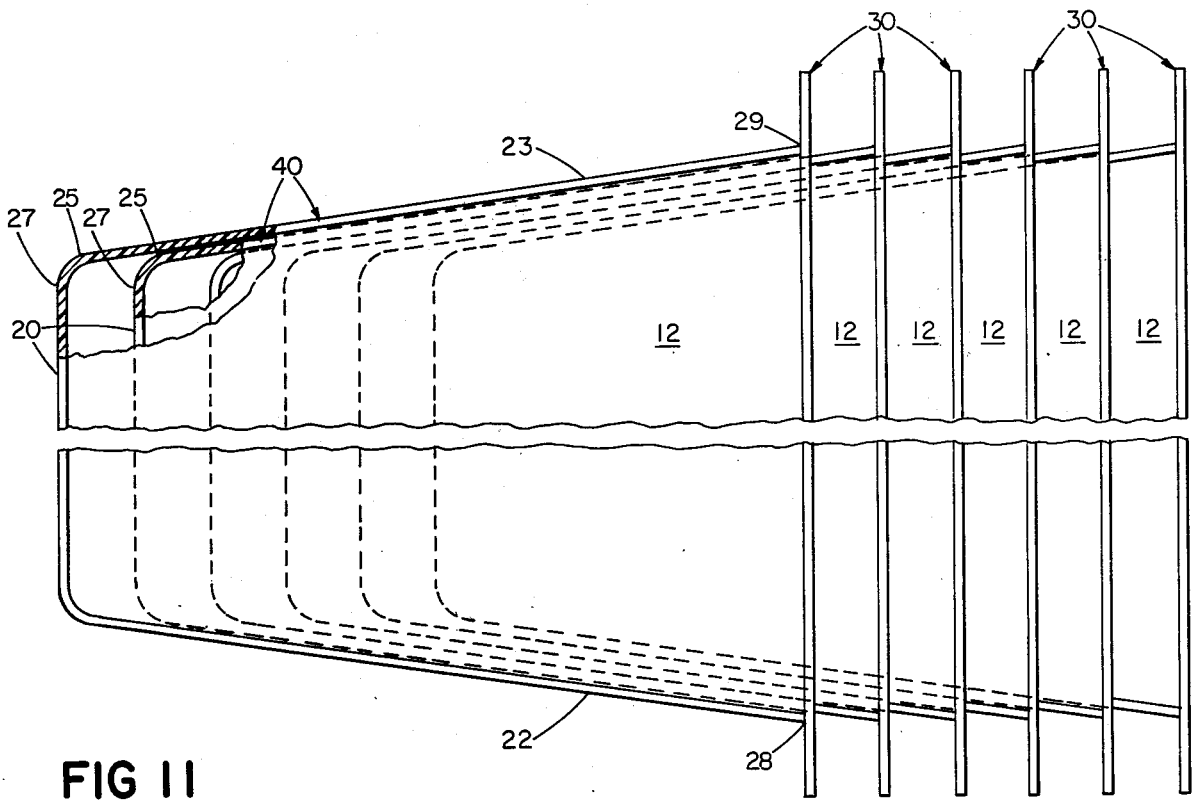
FIG. 11 is a plan view, partly broken away, of the nested shelf units.

As best shown in FIGS. 1, 4 and 6, integral planar external mounting flange wall 30 extends vertically upwardly from rear edge 16 of support wall 12, and outwardly from rear edges 28 and 29 of sidewalls 22 and 23 to provide an unobstructed rear opening 34 of greater horizontal dimension than front wall 20, whereby the shelf units are nestable within one another for storage and shipment as shown in FIGS. 10 and 11.

Support wall 12 has an integral upwardly extending rim 40 around its front edge 14 and side edges 18 and 19 to provide, together with flange wall 30, a recess 41 for the retention of liquid on the upper surface of support wall 12, as best shown in FIG. 1.

Mounting flange wall 30 is provided with central fastener hole 50 and side fastener holes 51 and 52 adapted to receive fastening means such as screws. The holes 51 and 52 are symetrically oriented on the right and left sides of flange 30 to provide for side-by-side mounting of similar units using common fastening means, such as screws 55, which are inserted into matched fastener holes 51 and 52 of adjacent overlapped mounting flanges, as shown in FIGS. 12 and 13.

What is claimed is:

1. An integrally molded, one-piece, nestable, plastic shelf unit comprising, a flat horizontal support wall having a front edge, a rear edge longer than said front edge, and side edges extending therebetween, the distance between said side edges increasing rearwardly, an integral front wall extending downwardly from the front edge of said support wall, integral sidewalls extending downwardly from the side edges of said support wall, and an integral external mounting flange wall extending outwardly from the rear edges of said support wall and said sidewalls providing an unobstructed rear opening of greater horizontal dimension than that of said front wall, whereby said shelf unit is nestable within another unit having the same construction, for storage and shipment.

2. A shelf unit as claimed in claim 1, wherein said support wall has a rim extending upwardly from said front and side edges thereof providing with said flange wall a depressed support wall for retention of liquid thereon.

3. A shelf unit as claimed in claim 1 wherein said side edges are symmetrical.

4. A shelf unit as claimed in claim 1, wherein said sidewalls have front edges contiguous with and of the same vertical length as the side edges of said front wall, and rear edges of greater vertical length than the front edges.

5. An integrally molded, one-piece, nestable, plastic shelf unit comprising, a flat horizontal support wall having a front edge, a rear edge longer than said front edge, and side edges extending therebetween, the distance between the side edges increasing symmetrically rearwardly, said support wall having an integral upwardly extending rim around the edges thereof, an integral front wall extending vertically downwardly from the front edge of said support wall, integral sidewalls extending vertically downwardly from the side edges of said support wall, said sidewalls having front edges contiguous with and of the same vertical length as the side edges of said front wall and rear edges of greater vertical length than said front wall, and an integral planar external mounting flange wall extending vertically upwardly from the rear edge of said support wall, and outwardly from the rear edges of said sidewalls, providing an unobstructed rear opening of greater horizontal dimension than that of said front wall, whereby said shelf unit is nestable within another unit having the same construction, for storage and shipment.

* * * * *